US007507326B2

(12) United States Patent
Farshid et al.

(10) Patent No.: US 7,507,326 B2
(45) Date of Patent: Mar. 24, 2009

(54) PROCESS FOR THE UPGRADING OF THE PRODUCTS OF FISCHER-TROPSCH PROCESSES

(75) Inventors: Darush Farshid, Larkspur, CA (US); Richard O. Moore, Jr., San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 911 days.

(21) Appl. No.: 10/713,474

(22) Filed: Nov. 14, 2003

(65) Prior Publication Data

US 2005/0103683 A1 May 19, 2005

(51) Int. Cl.
*C10G 47/00* (2006.01)
*C07C 27/26* (2006.01)

(52) U.S. Cl. ..... 208/108; 208/100; 518/726

(58) Field of Classification Search ..... 208/108, 208/100; 518/726

See application file for complete search history.

(56) References Cited

U.S. PATENT DOCUMENTS 4,052,477 A * 10/1977 Ireland et al. ..... 208/57
4,851,109 A * 7/1989 Chen et al. ..... 208/58
5,882,505 A * 3/1999 Wittenbrink et al. ..... 208/59
5,888,376 A * 3/1999 Wittenbrink et al. ..... 208/59
6,103,773 A * 8/2000 Wittenbrink et al. ..... 518/702
6,200,462 B1 * 3/2001 Cash et al. ..... 208/89
6,224,747 B1 5/2001 Cash et al.
6,475,375 B1 * 11/2002 Dancuart ..... 208/78
6,583,186 B2 6/2003 Moore, Jr.
6,797,154 B2 * 9/2004 Mukherjee et al. ..... 208/58

* cited by examiner

*Primary Examiner*—Glenn Caldarola
*Assistant Examiner*—John C Douglas
(74) *Attorney, Agent, or Firm*—Edward T. Mickelson; Penny L. Prater

(57) ABSTRACT

The present invention is directed to a method for hydroprocessing Fischer-Tropsch products. The invention in particular relates to an integrated method for producing liquid fuels from a hydrocarbon stream provided by Fischer-Tropsch synthesis. The method involves separating the Fischer-Tropsch products into a light fraction (FT condensate) and a heavy fraction. The heavy fraction is subjected to hydrocracking conditions, preferably through multiple catalyst beds, to reduce the chain length. The products of the hydrocracking reaction following the last catalyst bed are subjected to a separation step. The lighter material is combined with the Fischer-Tropsch condensate and hydrotreated. The hydrotreatment conditions hydrogenate double bonds, reduce oxygenates to paraffins, and desulfurize and denitrify the products. The heavier material from the separation step is sent to the lube plant for hydroisomerization, or is subjected to subsequent fraction steps to produce fuels and middle distillates.

11 Claims, 3 Drawing Sheets

M/U $H_2$
Preheated FT Wax
FT Condensate
HCR
COMPRESSOR
HDT
FRACTIONATOR
CHPS
CLPS
HHPS
HLPS
To Fuel Gas
1
2
3
4
5
10
14
15
17
18
19
20
21
22
25
26
27
28
29
31
32
33
34
35
36
37
40
42
43
44
50
55
65
70

PROCESS FOR THE UPGRADING OF THE PRODUCTS OF FISCHER-TROPSCH PROCESSES

FIELD OF THE INVENTION

The instant invention is directed to a means for hydroprocessing Fischer-Tropsch products in which hydrocracking of distillate range components is minimized.

BACKGROUND OF THE INVENTION

The majority of combustible liquid fuel used in the world today is derived from crude oil. However, there are several limitations to using crude oil as a fuel source. For example, crude oil is in limited supply; it includes aromatic compounds believed to cause cancer and contains sulfur and nitrogen-containing compounds that can adversely affect the environment.

Alternative sources for developing combustible liquid fuel are desirable. An abundant source is natural gas. The conversion of natural gas to combustible liquid fuel typically involves converting the natural gas, which is mostly methane, to synthesis gas, or syngas, which is a mixture of carbon monoxide and hydrogen. An advantage of using fuels prepared from syngas is that they typically do not contain appreciable amounts of nitrogen and sulfur and generally do not contain aromatic compounds. Accordingly, they have less health and environmental impact than conventional petroleum-based fuels. Fischer-Tropsch synthesis is a preferred means for converting syngas to higher molecular weight hydrocarbon products.

Fischer-Tropsch synthesis is often performed under conditions which produce a large quantity of $C_{20}$+wax, which must be hydroprocessed to provide distillate fuels. Often, the wax is hydrocracked to reduce the chain length, and then hydrotreated to reduce oxygenates and olefins to paraffins. Although some catalysts have been developed with selectivity for longer chain hydrocarbons, the hydrocracking tends to reduce the chain length of all of the hydrocarbons in the feed. When the feed includes hydrocarbons that are already in a desired range, for example, the distillate fuel range, hydrocracking of these hydrocarbons is undesirable.

It would be advantageous to provide a method for hydroprocessing Fischer-Tropsch wax which minimizes the hydrocracking of hydrocarbons in the distillate fuel range. The present invention provides such methods.

U.S. Pat. No. 6,583,186 discloses a means of hydroprocessing Fischer-Tropsch products without overcracking distillate components. In this scheme, however, all of the heavier, hydrocracked material is recombined with lighter materials, such as Fischer-Tropsch condensate and subsequently hydrotreated. There is no interstage separation step following hydrocracking, as in the instant invention.

U.S. Pat. No. 6,224,747 discloses hydrocracking a VGO stream in a hydrocracking reaction zone within an integrated hydroconversion process. Effluent from the hydrocracking reaction zone is combined, without interstage separation with a light aromatic-containing feed stream, and the blended stream is hydrotreated in a hydrotreating reaction zone. The hydrocracked effluent serves as a heat sink for the hydrotreating reaction zone. The integrated reaction system provides a single hydrogen supply and recirculation system for use in two reaction systems. This patent is not directed to hydroprocessing of Fischer-Tropsch products, as is the instant invention. Furthermore, there is no interstage separation between the hydrocracking and hydrotreating stages.

SUMMARY OF THE INVENTION

The instant invention is directed to a means for hydroprocessing Fischer-Tropsch products in which hydrocracking of distillate range components is minimized. This results in reduction in capital investment, particularly for large scale plants, reduction in operating costs, and an increase in production of more valuable products.

The invention may be more particularly described as an integrated hydroconversion process for the treatment of Fischer-Tropsch products including a first hydrocarbon stream comprising a wax and a second hydrocarbon stream comprising a condensate, the process having at least two stages, a hydrocracking stage and a hydrotreating stage, each stage possessing at least one reaction zone, wherein the process comprises the following steps:

(a) combining a first hydrocarbon stream with a first hydrogen-rich gaseous stream to form a first feedstock;

(b) passing the first feedstock of step (a) to a hydrocracking reaction zone, which is maintained at hydrocracking conditions, to form a hydrocracking zone effluent comprising normally liquid phase components and normally gaseous phase components;

(c) passing the hydrocracking zone effluent of step (b) to a heat exchanger or series of exchangers, where it is cooled;

(d) separating the components of the cooled effluent of step (c) into a vapor stream and a liquid stream;

(e) combining the vapor stream of step (d) with the second hydrocarbon stream to form a second feedstock, the liquid stream of step (d) being passed to lubricant production or to further processing for manufacture of fuel and diesel products;

(f) passing the second feedstock of step (e) to a hydrotreating zone, which is maintained at conditions sufficient for reducing the content of sulfur, nitrogen, oxygenates and unsaturates present in the second hydrocarbon stream, to form a hydrotreating zone effluent;

(g) separating the hydrotreating zone effluent of step (f) into a liquid stream comprising products and a second hydrogen-rich gaseous stream;

(h) passing the liquid stream of step (g) to further processing, and passing the hydrogen-rich gaseous stream of step (g) to further separation into a light hydrogen-rich gaseous stream, and a stream comprising liquid products; and (i) recycling at least a portion of the hydrogen-rich gaseous stream of step (h) to the hydrocracking zone and hydrotreating zones.

DETAILED DESCRIPTION OF THE INVENTION

Feeds

Figure 1:
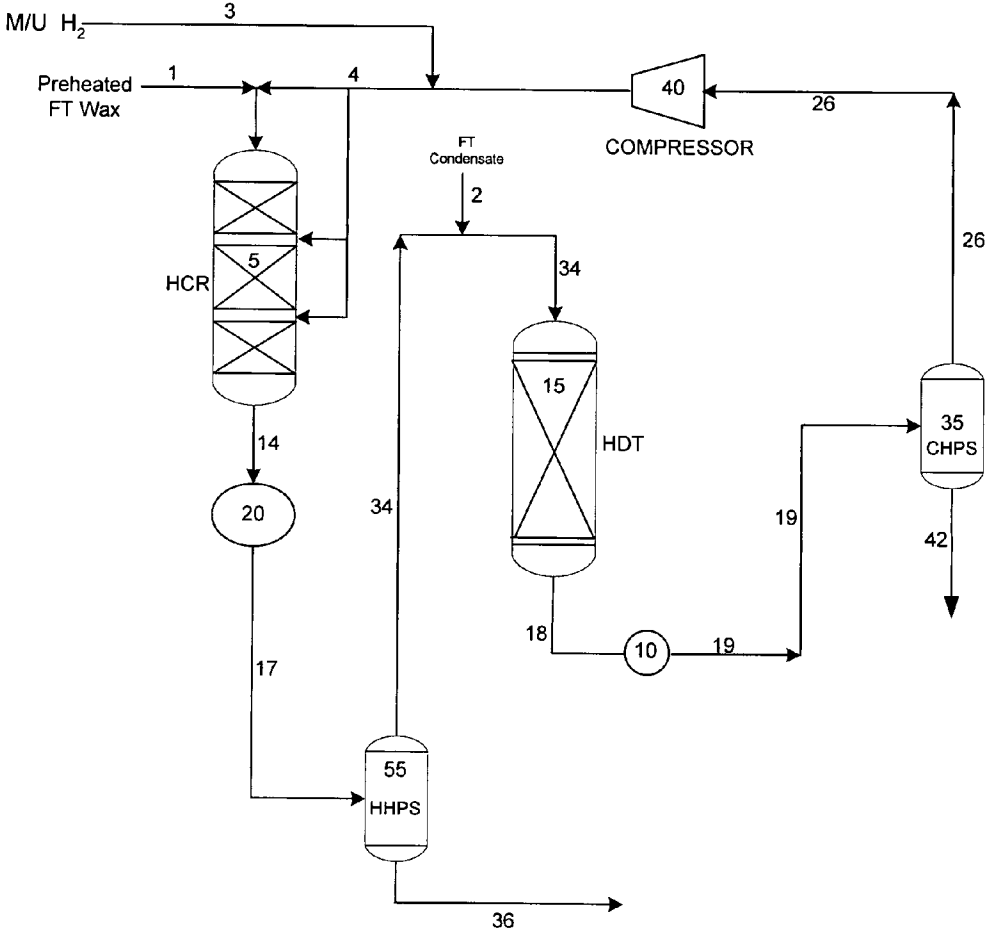
FIG. 1 illustrates the basic flow scheme of the preferred embodiment.

The products from Fischer-Tropsch reactions performed in slurry bed reactors generally include a light fraction (also known as a condensate fraction) and a heavy fraction (also known as a wax fraction). In the instant invention, the wax fraction comprises the feed to the hydrocracker and the condensate comprises a portion of the feed to the hydrotreater. The condensate includes hydrocarbons boiling below about 700° F. (e.g., tail gases through middle distillates, with increasingly smaller amounts of material up to about $C_{30}$), preferably in the range $C_5$-650° F. The waxy reaction product includes hydrocarbons boiling above about 600° F. (e.g., vacuum gas oil through heavy paraffins with increasingly smaller amounts of material down to about $C_{10}$).

When the gaseous reaction product (part of the condensate) from the Fischer-Tropsch synthesis step is being cooled and condensed and various fractions collected, the first liquid fractions collected tend to have higher average molecular weights than subsequent fractions.

The light and heavy fractions described above can optionally be combined with hydrocarbons from other streams, for example, streams from petroleum refining. The light fractions can be combined, for example, with similar fractions obtained from the fractional distillation of crude oil and/or liquids recovered from natural gas wells. The heavy fractions can be combined, for example, with waxy crude oils, crude oils and/or slack waxes from petroleum deoiling and dewaxing operations.

The light fraction typically includes a mixture of hydrocarbons, including mono-olefins and alcohols. The mono-olefins are typically present in an amount of at least about 5.0 wt % of the fraction. The alcohols are usually present in an amount typically of at least about 0.5 wt % or more.

Conditions—Hydrocracking Stage

Reaction conditions in the hydrocracking reaction zone include a reaction temperature between about 250° C. and about 500° C. (482° F.-932° F.), pressures from about 3.5 MPa to about 24.2 MPa (500-3,500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310-11,750 standard cubic feet per barrel). Preferred reaction temperatures range from about 340° C. to about 455° C. (644° F.-851° F.). Preferred total reaction pressures range from about 6.9 MPa to about 20.7 MPa (1,000-3,000 psi). With the preferred catalyst system, it has been found that preferred process conditions include contacting a hydrocarbon feedstock with hydrogen under hydrocracking conditions comprising a pressure of about 6.9 MPa to about 20.7 MPa (1,000-3000 psi), a gas to oil ratio between about 379-909 std liters $H_2$/kg oil (2,500-6,000 scf/bbl), a LHSV of between about 0.5-1.5 $hr^{-1}$, and a temperature in the range of 350° C. to 427° C. (662° F.-800° F.).

Conditions in the hydrocracking stage are sufficient to effect a boiling point conversion of at least 25%, preferably between 30% and 90%. Conversion involves breaking the relatively high boiling molecules of the feed into lower boiling components.

Catalysts—Hydrocracking Stage

The hydrocracking stage and the hydrotreating stage may each contain one or more catalysts. If more than one distinct catalyst is present in either of the stages, they may either be blended or be present as distinct layers. Layered catalyst systems are taught, for example, in U.S. Pat. No. 4,990,243, the disclosure of which is incorporated herein by reference for all purposes. Hydrocracking catalysts useful for the hydrocracking stage are well known. In general, the hydrocracking catalyst comprises a cracking component and a hydrogenation component on an oxide support material or binder. The cracking component may include an amorphous cracking component and/or a zeolite, such as a Y-type zeolite, an ultrastable Y type zeolite, or a dealuminated zeolite. A suitable amorphous cracking component is silica-alumina.

The hydrogenation component of the catalyst particles is selected from those elements known to provide catalytic hydrogenation activity. At least one metal component selected from the Group VIII (IUPAC Notation) elements and/or from the Group VI (IUPAC Notation) elements are generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The hydrocracking catalyst particles of this invention may be prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 649° C. (1200° F.) to produce the finished catalyst particles. Alternatively, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrocracking catalyst.

Conditions—Hydrotreater Stage

The hydrotreater is maintained at conditions sufficient to remove at least a portion of the nitrogen, oxygen and unsaturated compounds from the second hydrocarbon stream. The hydrotreater will operate at a lower temperature than the hydrocracker, except for possible temperature gradients resulting from exothermic heating within the reaction zones, optionally moderated by the addition of relatively cooler streams into the one or more reaction zones. Feed rate of the reactant liquid stream through the reaction zones will be in the region of 0.1 to 20 $hr^{-1}$ liquid hourly space velocity. Hydrotreating conditions typically used in the hydrotreater will include a reaction temperature between about 150° C. and about 500° C. (302° F.-932° F.), pressures from about 2.1 MPa to about 24.2 MPa (300-3,500 psig), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310-11,750 standard cubic feet per barrel).

Preferred reaction temperatures range from about 200° C. to about 427° C. (392° F.-800° F.). Preferred total reaction pressures range from about 6.9 MPa to about 20.7 MPa (1,000-3,000 psi).

The hydrotreating stage contains hydrotreating catalyst, maintained at hydrotreating conditions. Catalysts known for hydrotreating are useful for the hydrotreater. Such hydrotreating catalysts are suitable for hydroconversion of feedstocks containing sulfur, nitrogen, oxygenates and/or unsaturated molecules. Such catalysts generally contain at least one metal component selected from Group VIII (IUPAC Notation) and/or at least one metal component selected from the Group VI (IUPAC notation) elements. Group VI elements include chromium, molybdenum and tungsten. Group VIII elements include iron, cobalt and nickel. While the noble metals, especially palladium and/or platinum, may be included, alone or in combination with other elements, in the hydrotreating catalyst, use of the noble metals as hydrogenation components is not preferred. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulfidic form. If a combination of at least a Group VI and a Group VIII metal component is present as (mixed) oxides, it will be subjected to a sulfiding treatment prior to proper use in hydrotreating. Suitably, the catalyst comprises one or more components of nickel and/or cobalt and one or more components of molybdenum and/or tungsten. Catalysts containing cobalt and molybdenum are particularly preferred.

The hydrotreating catalyst particles of this invention are suitably prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 649° C. (1200° F.) to produce the finished catalyst particles. Alternatively, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrotreating catalyst.

The subject process is especially useful in the production of middle distillate fractions boiling in the range of about 121° C.-371° C. (250° F.-700° F.) as determined by the appropriate ASTM test procedure. By a middle distillate fraction having a boiling range of about 121° C.-371° C. (250° F.-700° F.) is meant that at least 75 vol %, preferably 85 vol %, of the components of the middle distillate have a normal boiling point of greater than about 121° C. (250° F.) and furthermore that at least about 75 vol %, preferably 85 vol %, of the components of the middle distillate have a normal boiling point of less than 371° C. (700° F.). The term "middle distillate" is intended to include the diesel, jet fuel and kerosene boiling range fractions. The kerosene or jet fuel boiling point range is intended to refer to a temperature range of about 138° C.-274° C. (280° F.-525° F.), and the term "diesel boiling range" is intended to refer to hydrocarbon boiling points of about 121° C.-371° C. (250° F.-700° F.). Gasoline or naphtha is normally the $C_5$ to 204° C. (400° F.) endpoint fraction of available hydrocarbons. The boiling point ranges of the various product fractions recovered in any particular plant will vary with such factors as the characteristics of the hydrocarbon source, plant local markets, product prices, etc. Reference is made to ASTM standards D 975 and D 3699 83 for further details on kerosene and diesel fuel properties.

Reference is now made to FIG. 1, which discloses preferred embodiments of the invention. Not included in the figures are various pieces of auxiliary equipment such as heat exchangers, condensers, pumps and compressors, which are not essential to the invention.

DESCRIPTION OF THE PREFERRED EMBODIMENT

In FIG. 1, two downflow reactor vessels, 5 and 15, are depicted. The first stage reaction, hydrocracking, occurs in vessel 5. The second stage, hydrotreating, occurs in vessel 15. Each vessel contains at least one reaction zone. Vessel 5 is depicted as having three catalyst beds, while vessel 15 is depicted as possessing a single catalyst bed. The first reaction vessel 5 is for cracking a first hydrocarbon stream 1, which is comprised primarily of preheated Fischer-Tropsch wax and recycle hydrocarbon from fractionation. The hydrocarbon feed is partially converted into products in the reactor. The reactor effluent 14 comprises light vaporized hydrocarbons, distillate oils, heavy unconverted hydrocarbon, and excess hydrogen not consumed in the reaction. The effluent stream 14 is slightly cooled by heat exchange (Exchanger 20) before it is sent, as stream 17, to a hot high pressure separator (HHPS) 55. The second reaction vessel 15, a hydrotreater removes nitrogen-containing, oxygen-containing and unsaturated molecules from a second hydrocarbon stream 34. Stream 34 contains vapor from the HHPS, which is combined with preheated condensate from line 2.

In the integrated process of this invention, a first hydrocarbon stream 1 is combined with a hydrogen-rich gaseous stream 4 to form a first feedstock 12 which is passed to first reaction vessel 5. Hydrogen-rich gaseous stream 4 contains greater than 50% hydrogen, the remainder being varying amounts of light gases, including hydrocarbon gases. The hydrogen-rich gaseous stream 4 shown in the drawing is a blend of make-up hydrogen 3 and recycle hydrogen 26. While the use of a recycle hydrogen stream is generally preferred for economic reasons, it is not required. First feedstock 1 may be heated in one or more exchangers or in one or more heaters (this is not depicted in FIG. 1) before being combined with hydrogen-rich stream 4 to create stream 12. Stream 12 is then introduced to first reaction vessel 5, where the first stage, in which hydrocracking preferably occurs, is located. The second stage is located in vessel 15, where hydrotreating preferably occurs.

The effluent from the first stage, stream 14 is cooled in heat exchanger 20. Stream 14 emerges from exchanger 20 as stream 17 and passes to the HHPS 55. The liquid stream 36 emerges from the HHPS 55 and proceeds to further processing. A stream (not shown) may be taken from stream 36 and passed to a lubricant base oil plant. The lubricant plant (not shown) comprises a catalytic dewaxing unit followed by a hydrofinishing unit. Waxy material not converted in the dewaxer may be recycled to stream 1 for further processing, while dewaxed effluent is hydrofinished. The hydrofinished material is subsequently subjected to atmospheric distillation. Heavier streams may then be vacuumed distilled to produce light and heavy base hydrocarbon stocks.

The gaseous stream 34 emerges from the HHPS 55, and joins with stream 2, which comprises Fischer-Tropsch condensate, before entering vessel 15 for hydrotreating. Vessel 15 effluent is stream 18.

The second reaction zone, found in vessel 15, contains at least one bed of catalyst, such as hydrotreating catalyst, which is maintained at conditions sufficient for converting at least a portion of the nitrogen, oxygen and at least a portion of the unsaturated compounds in the second feedstock.

Stream 18, the second stage effluent (vessel 15), contains thermal energy which may be recovered by heat exchange with other process streams, such as in heat exchanger 10. The hydrotreater effluent stream 18 may also be cooled with air coolers (not shown). If necessary, wash water may be injected upstream of the air coolers to prevent the deposition of salts in the air cooler tubes. Second stage effluent 18 emerges from exchanger 10 as stream 19 and is passed to cold high pressure separator CHPS 35. The liquid effluent of the CHPS 35, stream 42, passes to fractionation. Gaseous overhead stream 26, comprising primarily hydrogen and some other light gases, passes to the compressor 40, where it is recompressed and passed as recycle to one or more of the reaction vessels and as a quench stream for cooling the reaction zones. Such uses of hydrogen are well known in the art.

Stream 26 may pass through an absorber (not shown) which includes means for contacting the stream with an alkaline aqueous solution, for removing contaminants such as hydrogen sulfide and ammonia which may be generated in the reaction zones. The hydrogen-rich gaseous stream 26 is preferably recovered from the absorber at a temperature in the range of 38° C.-149° C. (100° F.-300° F.) or 38° C.-93° C. (100° F.-200° F.).

Stream 26 then flows into the recycle gas compressor suction. The recycle compressor delivers the recycle gas to vessel 5, as stream 4. Part of the recycle compressor discharge gas, now stream 4, is routed to the hydrocracker reactor, vessel 5, as quench to control the reactor temperature. The remaining recycle gas that is not used as quench is combined with make-up hydrogen to become the hydrocracker reactor feed gas. The hydrocracker reactor feed gas is heated by process streams before combining with the Fischer-Tropsch wax and recycle hydrocarbon stream 1.

Figure 2:
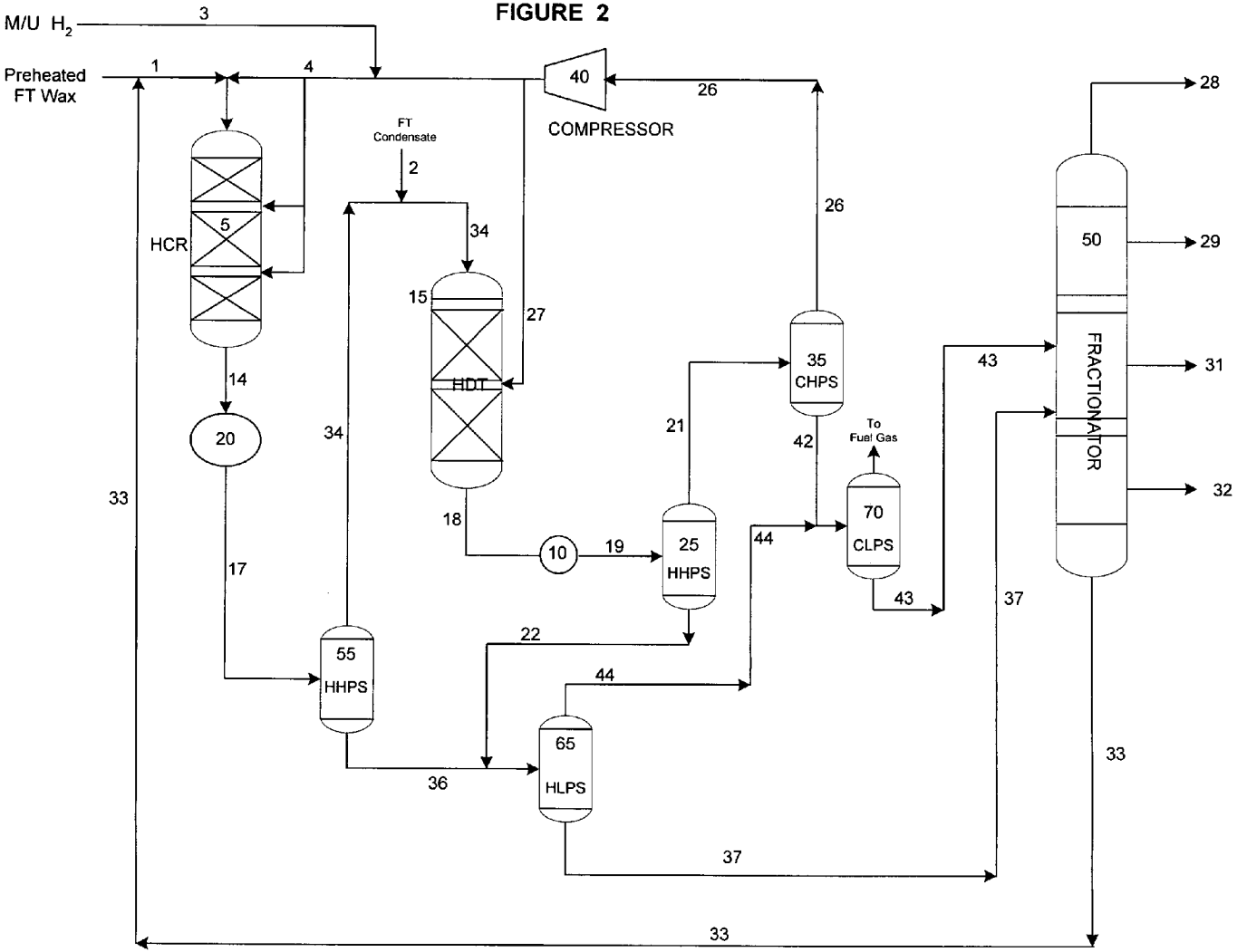
FIGS. 2 and 3 show variations of the basic flow scheme.

FIG. 2 illustrates the base invention of FIG. 1 as adapted for fuels production. The hydrotreating reactor 15 is modified, in the fuels case, to employ at least two beds, rather than one. Hydrogen, in line 27, is used as an inter-bed quench.

Line 19, the cooled effluent of hydrotreater 15, passes to the hot high pressure separator 25, where it is separated into a gaseous stream 21 and a heavier stream 22. The gaseous stream 21 passes to the cold high pressure separator 35, where processing continues as described in the discussion of FIG. 1, with overhead stream 26 passing to compressor 40 and liquid effluent 42 being further processed.

Stream 22, the liquid effluent of hot high pressure separator 25, is combined with stream 36, shown in FIG. 1.

Stream 36 enters hot low pressure separator 65, where it is separated into overhead stream 44 and liquid effluent 37. Stream 44 combines with stream 42 and proceeds to cold low pressure separator 70. Fuel gas is removed overhead while liquid effluent 43 is passed to fractionator 50.

Stream 37 also passes to fractionator 50, where it is separated into overhead gasoline stream 28, naphtha stream 29, kerosene fraction 31 and diesel stream 32. Bottoms stream 33 is recycled to the hydrocracker 5. A preferred distillate product has a boiling point range within the temperature range 121-371° C. (250° F.-700° F.). A gasoline or naphtha fraction having a boiling point within the temperature range $C_5$-204° C.($C_5$-400° F.) is also desirable.

Figure 3:
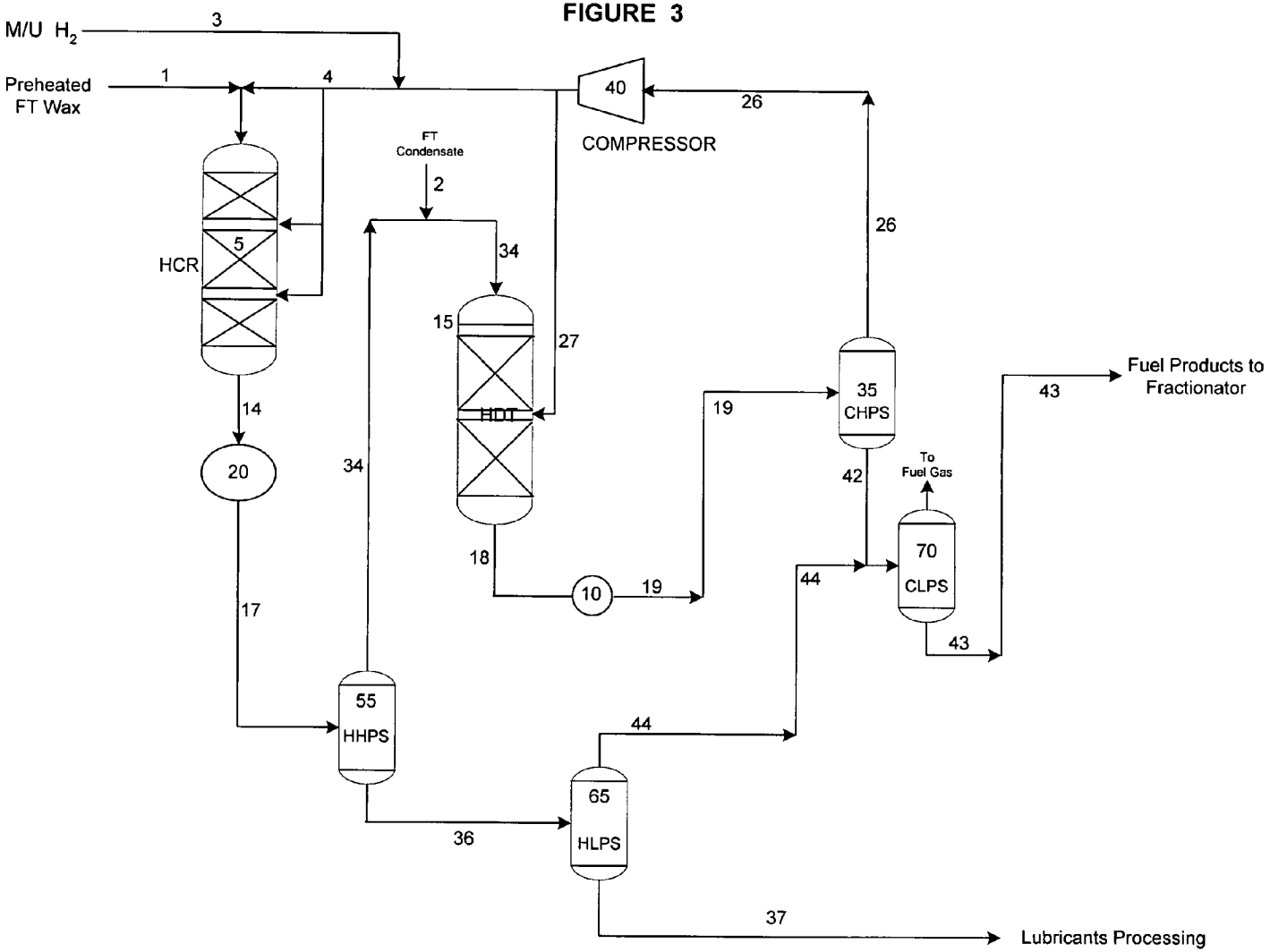

FIG. 3 illustrates the base invention of FIG. 1 as adapted for lubricant production. The hydrotreating reactor 15 is modified, in the lubricant case, to employ at least two beds, rather than one. Hydrogen, in line 27, is used as an inter-bed quench.

Stream 18, the effluent of hydrotreater 15, is cooled in heat exchanger 10 and passed, as stream 19 to cold high pressure separator 35, as depicted in FIG. 1. Overhead stream 26 passes to compressor 40, as depicted in FIG. 1 and liquid effluent 42 is further processed as depicted in FIG. 2. Stream 44 combines with stream 42 and proceeds to cold low pressure separator 70. Fuel gas is removed overhead while liquid effluent 43 is passed to fractionator (not shown).

Stream 36, liquid effluent from the hot high pressure separator 55 is separated into gaseous stream 44 and liquid stream 37, as depicted in FIG. 2, the fuels case. Unlike FIG. 2, however, line 37 proceeds to lubricants processing (details not shown, but including dewaxing procedures) rather than passing to fractionator.

What is claimed is:

1. An integrated hydroconversion process for the treatment of Fischer-Tropsch products including a first hydrocarbon stream comprising a wax and a second hydrocarbon stream comprising a condensate, the process having at least two stages, a hydrocracking stage and a hydrotreating stage, each stage possessing at least one reaction zone, wherein the process comprises the following steps:

(a) combining a first hydrocarbon stream with a first hydrogen-rich gaseous stream to form a first feedstock;

(b) passing the first feedstock of step (a) to a hydrocracking reaction zone, which is maintained at hydrocracking conditions, to form a hydrocracking zone effluent comprising normally liquid phase components and normally gaseous phase components;

(c) passing the hydrocracking zone effluent of step (b) to a heat exchanger or series of exchangers, where it is cooled;

(d) separating the components of the cooled effluent of step (c) into a vapor stream and a liquid stream;

(e) combining the vapor stream of step (d) with the second hydrocarbon stream to form a second feedstock, the liquid stream of step (d) being passed to lubricant production or to further processing for manufacture of fuel and diesel products;

(f) passing the second feedstock of step (e) to a hydrotreating zone, which is maintained at conditions sufficient for reducing the content of sulfur, nitrogen, oxygenates and unsaturates present in the second hydrocarbon stream, to form a hydrotreating zone effluent;

(g) separating the hydrotreating zone effluent of step (f) into a liquid stream comprising products and a second hydrogen-rich gaseous stream;

(h) passing the liquid stream of step (g) to further processing, and passing the hydrogen-rich gaseous stream of step (g) to further separation into a light hydrogen-rich gaseous stream, and a stream comprising liquid products; and (i) recycling at least a portion of the hydrogen-rich gaseous stream of step (h) to the hydrocracking zone and hydrotreating zones.

2. The process of claim 1, wherein the liquid stream comprising products of step (h) is passed to further separation into a liquid products stream as well as light gaseous components which are sent to fuel gas.

3. The process of claim 1, wherein the liquid products stream of claim 2 is sent to fractionation and separated into product streams comprising gas or naphtha stream which are removed overhead, one or more middle distillate streams, and a bottoms stream suitable for further processing.

4. The process according to claim 1, wherein further processing for manufacture of fuel and diesel products of the liquid stream of step (d) further comprises:

(a) combining the liquid stream of claim 1, step (d), with the liquid fraction of claim 1, step (g), to form a single stream;

(b) separating the single stream of step 4(a) into a light stream and a heavy stream, the heavy stream being sent to fractionation;

(c) combining the light stream of step 4(b) with the products stream of claim 1, step (h), to form a single stream; and (d) separating the single stream of step 4(c) into a light gaseous stream and a liquid products stream, the light gaseous stream proceeding to fuel gas and the liquid products stream proceeding to fractionation.

5. The process according to claim 1, wherein the hydrocracking zone of step 1(b) is maintained at conditions sufficient to effect a boiling range conversion of the first hydrocarbon stream of at least about 25%.

6. The process according to claim 5, wherein the hydrocracking zone of step 1(b) is maintained at conditions sufficient to effect a boiling range conversion of the first hydrocarbon stream of between 30% and 90%.

7. The process according to claim 1, wherein the waxy first hydrocarbon stream of claim 1 has a normal boiling point greater than about 600° F.

8. The process according to claim 1, wherein the second hydrocarbon stream of claim 1 has a normal boiling point below 700° F.

9. The process according to claim 8, wherein the second hydrocarbon stream boils in the range $C_5$-650° F.

10. The process according to claim 1, wherein the reaction zone of step 1(b) stage is maintained at hydrocracking reaction conditions, including a reaction temperature in the range from about 340° C. to about 455° C. (644° F.-851° F.), a reaction pressure in the range of about 3.5-24.2 MPa (500-3500 pounds per square inch), a feed rate (vol oil/vol cat h) from about 0.1 to about 10 $hr^{-1}$ and a hydrogen circulation rate ranging from about 350 std liters $H_2$/kg oil to 1780 std liters $H_2$/kg oil (2,310-11,750 standard cubic feet per barrel).

11. The process according to claim 1, wherein the reaction zone of step 1(g) is maintained at hydrotreating reaction conditions, including a reaction temperature in the range of from about 150° C. to about 500° C. (302° F.-932° F.), a reaction pressure in the range of from about 2.1 MPa to 24.2 MPa (300-3,500 psi), a feed rate (vol oil/vol cat $hr^{-1}$) from about 0.1 to about 20 $hr^{-1}$, and a hydrogen circulation rate in the range from about 350 std liters $H_2$/kg oil to 1780 std liters $H_2$/kg oil (2,310-11,750 standard cubic feet per barrel).

* * * * *